US009364092B2

(12) United States Patent
Piretti

(10) Patent No.: US 9,364,092 B2
(45) Date of Patent: Jun. 14, 2016

(54) CHAIR WITH A TILTING BACKREST

(71) Applicant: PRO-CORD S.p.A., Bologna (IT)

(72) Inventor: Alessandro Piretti, Bologna (IT)

(73) Assignee: Pro-Cord S.P.A., Bologna (IT)

( * ) Notice: Subject to any disclaimer, the term of this patent is extended or adjusted under 35 U.S.C. 154(b) by 0 days.

(21) Appl. No.: 14/567,096

(22) Filed: Dec. 11, 2014

(65) Prior Publication Data

US 2015/0164231 A1 Jun. 18, 2015

(30) Foreign Application Priority Data

Dec. 13, 2013 (IT) ..... TO2013A1015

(51) Int. Cl.

| | |
|---|---|
| ***A47C 3/025*** | (2006.01) |
| ***A47C 3/04*** | (2006.01) |
| ***A47C 7/44*** | (2006.01) |
| ***A47C 7/54*** | (2006.01) |

(52) U.S. Cl.

CPC . *A47C 7/44* (2013.01); *A47C 7/445* (2013.01); *A47C 7/54* (2013.01)

(58) Field of Classification Search

CPC ..... A47C 7/44; A47C 7/445; A47C 7/54
USPC ..... 297/285, 286, 287, 288, 280, 294, 296, 297/297, 446.1, 446.2, 290, 450.1
See application file for complete search history.

(56) References Cited

U.S. PATENT DOCUMENTS

| | | | | | |
|---|---|---|---|---|---|
| 1,239,470 | A * | 9/1917 | Farrer | B60N 2/286 | 297/286 X |
| 2,131,609 | A * | 9/1938 | Alexander | A47C 20/027 | 297/296 X |
| 4,157,203 | A * | 6/1979 | Ambasz | A47C 7/441 | 297/285 |
| 4,379,589 | A * | 4/1983 | Marino | A47C 7/448 | 297/299 X |
| 4,580,836 | A * | 4/1986 | Verney | A47C 7/445 | 297/296 |
| 4,603,904 | A * | 8/1986 | Tolleson | A47C 7/445 | 297/285 X |
| 4,787,676 | A * | 11/1988 | Neve de Mevergnies | B60N 2/028 | 297/285 X |
| 4,856,846 | A * | 8/1989 | Lohmeyer | A47C 3/12 | 297/285 |
| 4,869,552 | A * | 9/1989 | Tolleson | A47C 7/445 | 297/296 X |

(Continued)

FOREIGN PATENT DOCUMENTS

| | | | | |
|---|---|---|---|---|
| DE | 3515631 | A1 * | 11/1985 | B60N 2/686 |
| DE | 202007000623 | U1 | 3/2007 | |

(Continued)

OTHER PUBLICATIONS

Italian Search Report and Written Opinion dated Jul. 10, 2014 for Application No. TO2013A001015.

*Primary Examiner* — Rodney B White
(74) *Attorney, Agent, or Firm* — Patterson & Sheridan, LLP

(57) ABSTRACT

A chair comprising a fixed support structure including a pair of front legs and a pair of rear legs, a seat fixed to said support structure, and a backrest including a backrest panel with an arcuate shape connected in a tilting manner to said fixed support structure, wherein said backrest comprises two side connecting elements of plastic material, each of which comprises a cylindrical sleeve fixed to an upper portion of a respective rear leg and a bellows-shaped deformable portion integrally formed with the respective cylindrical sleeve and connected in a fixed manner to a respective side portion of said backrest panel.

11 Claims, 4 Drawing Sheets

(56) References Cited

U.S. PATENT DOCUMENTS

| | | | | | |
|---|---|---|---|---|---|
| 4,913,493 | A * | 4/1990 | Heidmann | A47C 7/448 | 297/285 |
| 5,108,149 | A * | 4/1992 | Ambasz | A47C 7/443 | 297/297 |
| 5,704,688 | A * | 1/1998 | Schrewe | A47C 7/445 | 297/285 |
| 6,739,663 | B2 * | 5/2004 | Gevaert | A47C 7/445 | 297/296 |
| 6,843,529 | B2 * | 1/2005 | Ballendat | A47C 3/04 | 297/239 |
| 7,226,127 | B1 * | 6/2007 | Yevko | A47C 7/44 | 297/285 X |
| 7,416,252 | B2 * | 8/2008 | Lor | A47C 7/443 | 297/285 |
| 7,625,044 | B2 * | 12/2009 | Piretti | A47C 7/46 | 297/284.4 |
| 7,681,952 | B2 * | 3/2010 | Piretti | A47C 7/445 | 297/297 |
| 7,971,935 | B2 * | 7/2011 | Saez | A47C 3/04 | 297/285 |
| 8,282,166 | B2 * | 10/2012 | Piretti | A47C 7/445 | 297/294 |
| 8,851,564 | B2 * | 10/2014 | Seo | A47C 7/00 | 297/287 X |
| 2008/0185890 | A1 * | 8/2008 | Piretti | A47C 7/405 | 297/296 |
| 2012/0126587 | A1 | 5/2012 | Seo | | |

FOREIGN PATENT DOCUMENTS

| | | | |
|---|---|---|---|
| EP | 2110051 | A1 | 10/2009 |
| EP | 2183997 | A1 | 5/2010 |
| WO | 9103192 | A1 | 3/1991 |

* cited by examiner

CHAIR WITH A TILTING BACKREST

CROSS-REFERENCE TO RELATED APPLICATIONS

This application claims benefit of Italian patent application number TO2013A001015, filed Dec. 13, 2013, which is herein incorporated by reference.

BACKGROUND OF THE INVENTION

1. Field of the Invention

The present invention relates to a chair comprising a fixed support structure including a pair of front legs and a pair of rear legs, a seat attached to the fixed support structure, and a backrest connected in a tilting manner to the fixed support structure and elastically inclinable under a backward thrust applied by the user.

2. Description of Prior Art

In the state of the art, many chairs with backward-inclinable backrests are known. A solution that is particularly appreciated for its simplicity envisages obtaining the elastic movement of the backrest thanks to the deformability of the uprights that connect the backrest to the fixed support structure.

For example, the document EP-A-2110051 by the same Applicant describes a chair with a backrest comprising two ribbed support profiles each of which is essentially L-shaped, with a seat portion, a backrest portion and a rounded connecting portion between the seat portion and the backrest portion. Each of the ribbed support profiles is provided with a plurality of through cuts spaced apart from each other, which form respective localized bending points that allow a bending of the support profile in a vertical plane.

SUMMARY OF THE INVENTION

The object of the present invention is to provide a chair with a tilting backrest having a greater simplicity from a constructive point of view, more aesthetically elegant and less technical compared to the known solutions.

According to the present invention, this object is achieved by a chair having the characteristics forming the subject of claim 1.

The claims form an integral part of the disclosure provided in relation to the invention.

BRIEF DESCRIPTION OF THE DRAWINGS

The present invention will now be described in detail with reference to the accompanying drawings, given purely by way of non-limiting example, wherein.

DETAILED DESCRIPTION

Figure 1:
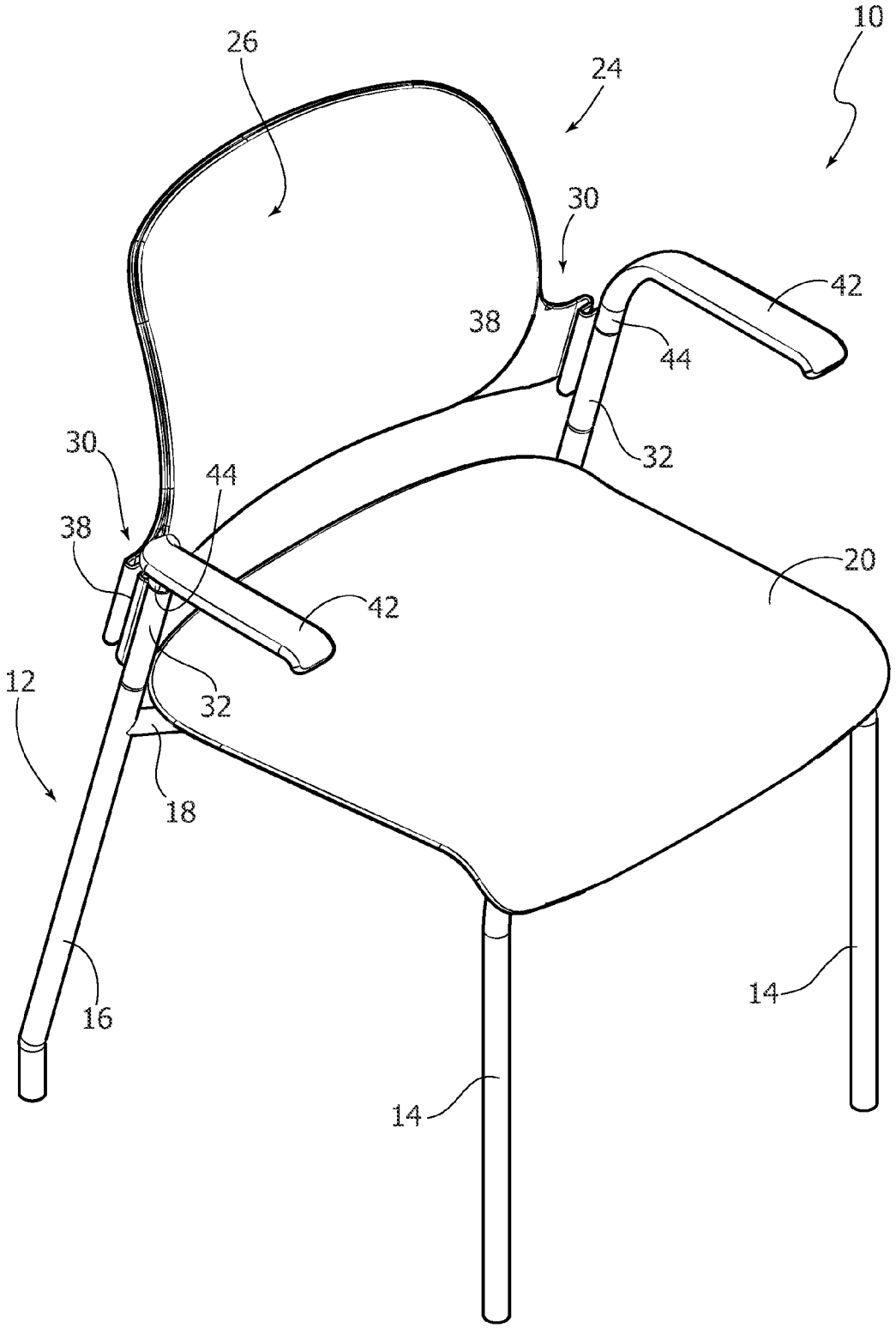
FIG. 1 is a perspective view of a chair according to the present invention.
Figure 2:
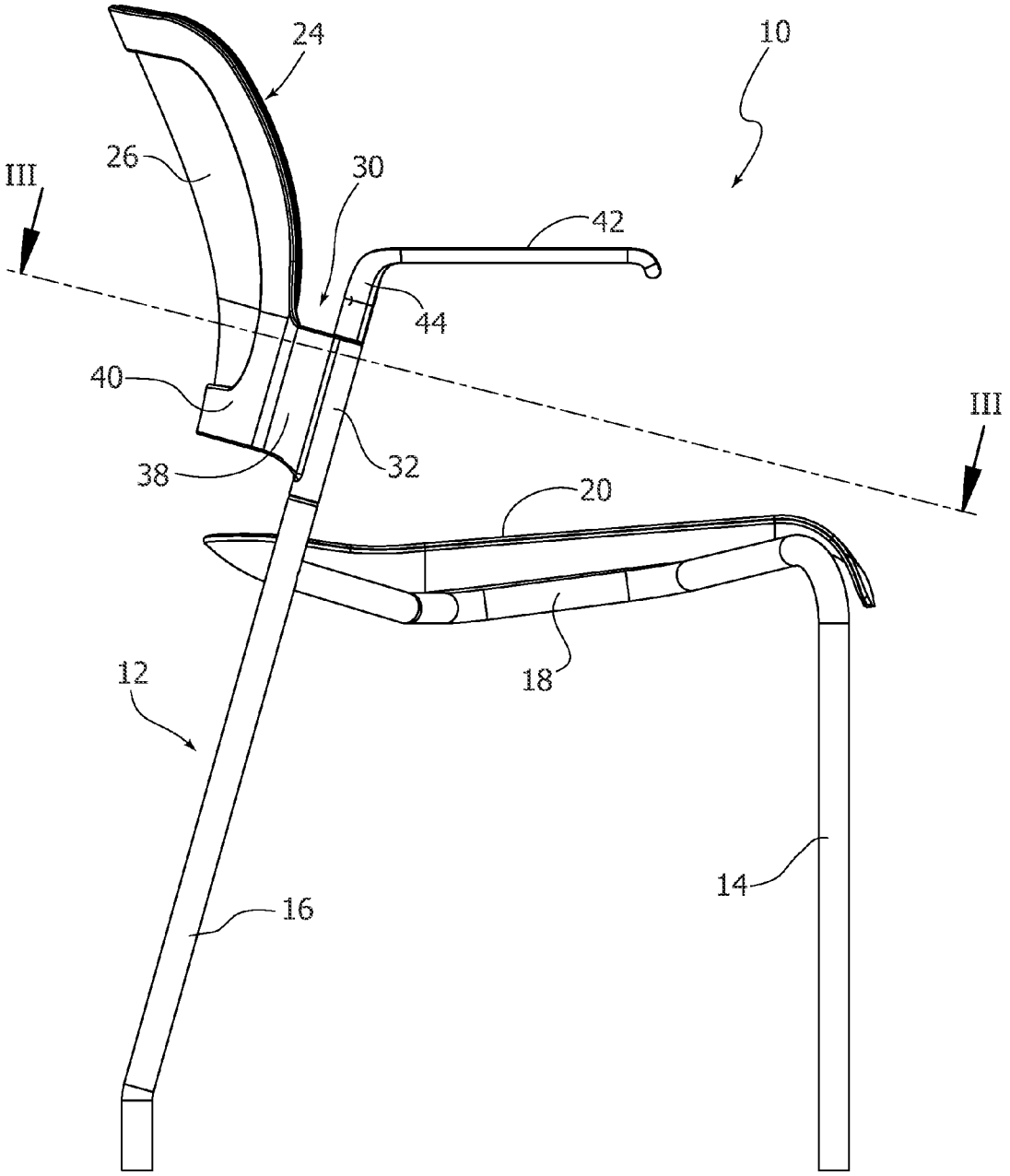
FIG. 2 is a side view of a chair of FIG. 1.
Figure 6:
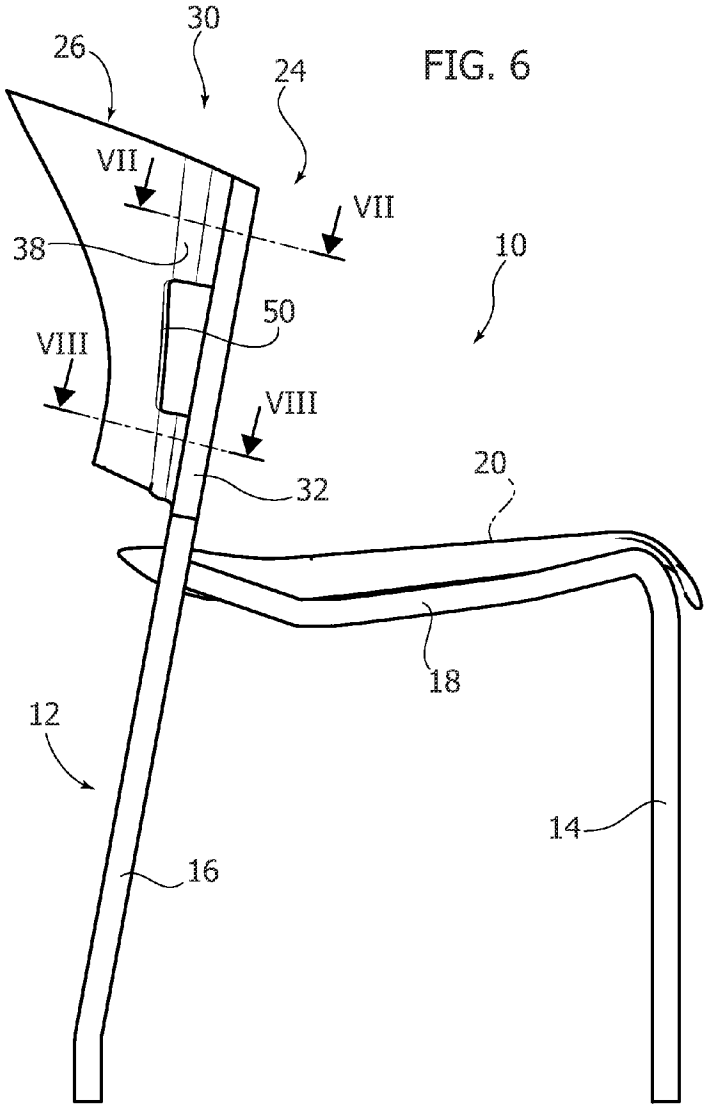
FIG. 6 is a side view illustrating an alternative embodiment of the chair according to the invention.

With reference to the Figures, numeral 10 indicates a chair according to the present invention. The chair 10 comprises a fixed support structure 12 including a pair of front legs 14 and a pair of rear legs 16. The front legs 14 and the rear legs 16 are interconnected by means of upper connecting elements 18 (FIGS. 2 and 6). A seat 20 is fixed to the upper connecting elements 18 of the support structure 12.

The seat 10 comprises a backrest 24 connected in a tilting manner to the support structure 12. The backrest 24 comprises a backrest panel 26 with an arcuate shape. The backrest panel 26 is connected to the rear legs 16 of the support structure 12 by means of two side connecting elements 30. Each of the side connecting elements 30 is preferably formed by a monolithic component made of injection-molded plastic material.

Figure 3:
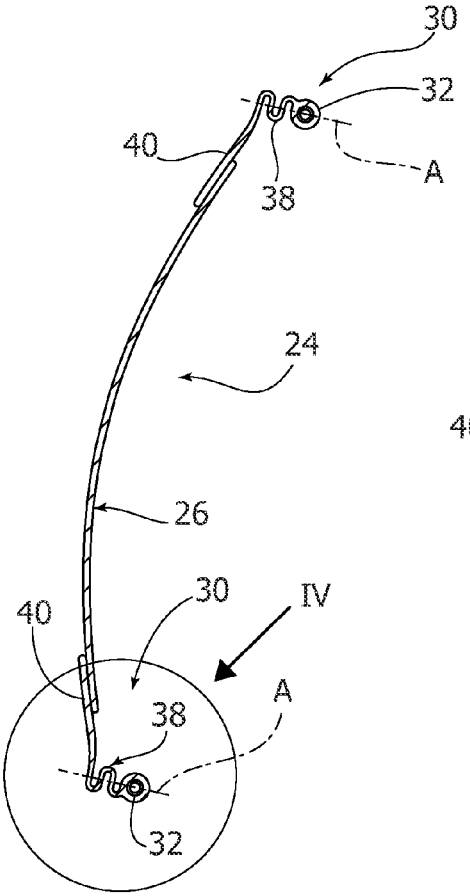
FIG. 3 is a cross-section along line III-III of FIG. 2.
Figure 4:
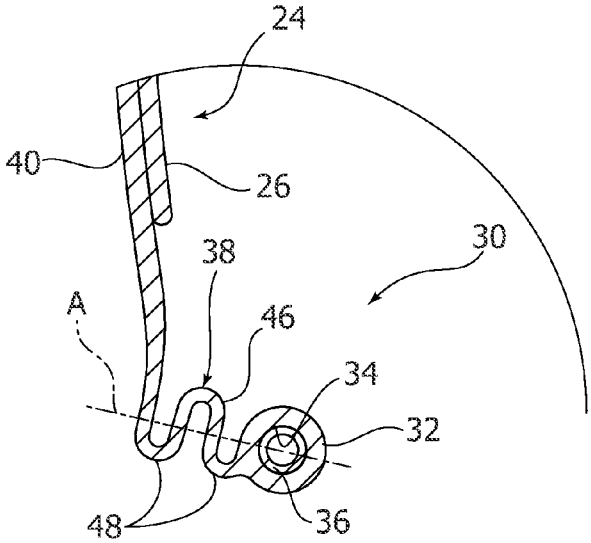
FIG. 4 is an enlarged detail of the part indicated by the arrow IV in FIG. 3.

With reference to FIGS. 3 and 4, each side connecting element 30 comprises a cylindrical sleeve 32 fixed to the upper portion of a respective rear leg 16. The cylindrical sleeve 32 has a circular cross-section with a diameter equal to the diameter of the rear legs 16. The lower end of each cylindrical sleeve 32 rests frontally on a shoulder formed on the upper portion of the corresponding rear leg 16. The cylindrical sleeves 32 form upward extensions of the rear legs 16 and have a geometric and aesthetic continuity with respect to the rear legs 16. Each cylindrical sleeve 32 has a longitudinal through-hole 34 which is fitted on a tubular element 36, which forms an upward extension of the respective rear leg 16. The tubular element 36 has a reduced diameter with respect to the outer diameter of the rear leg 16.

Each side connecting element 30 has a bellows-shaped deformable portion 38, integrally formed with the respective cylindrical sleeve 32. The bellows-shaped deformable portion 38 essentially has the same height as the cylindrical sleeve 32. The bellows-shaped deformable portions 38 are fixed with respect to the backrest panel 26. In the embodiment illustrated in FIGS. 1 to 5, the two bellows-shaped deformable portions 38 are integrally formed as side extensions of a frame 40. The frame 40 is fixed to the rear surface of the backrest panel 26 and extends along the perimeter of the backrest panel 26.

Figure 7:
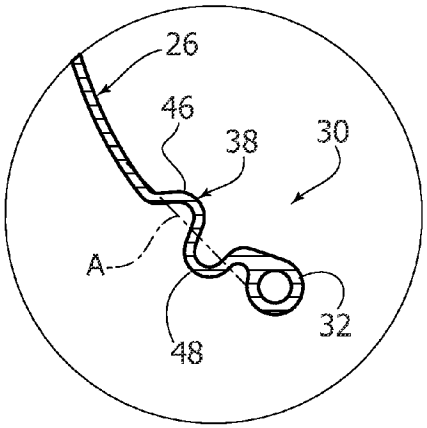
FIGS. 7 and 8 are details in cross-section according to the lines VII-VII and VIII-VIII of FIG. 6.
Figure 8:
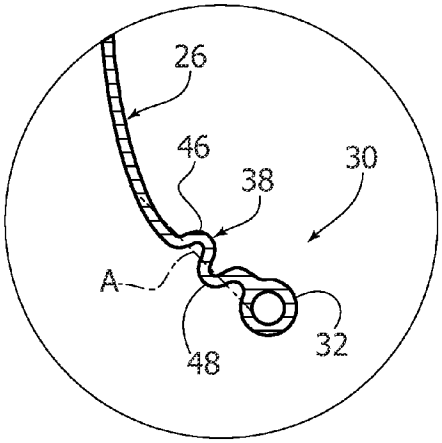

In the embodiment illustrated in FIGS. 6 to 8, the backrest panel 26 is integrally formed with the connecting elements 30. The bellows-shaped deformable portions 38 are formed by side extensions of the backrest panel 26.

In the embodiment illustrated in FIGS. 1 to 5, the bellows-shaped deformable portions 38 have a height less than the height of the backrest panel 26 and are located at the lower end of the backrest panel 26. In the variant illustrated in FIGS. 6 to 8, the bellows-shaped deformable portions 38 essentially have the same height as the backrest panel 26. In the version illustrated in FIGS. 1 and 2, the chair 10 may be provided with two arms 42 having respective fastening portions 44, which extend upward from the respective cylindrical sleeves 32. The fastening portions 44 of the arms 42 are fixed to the respective tubular elements 36, which extend within the sleeves 32.

Each bellows-shaped deformable portion 38 has curved portions 46, 48 opposite to each other. In FIG. 4, A indicates the central plane of the bellows, defined as the plane located at an essentially central position between the opposite curved portions 46, 48. In the embodiment illustrated in FIGS. 1 to 4, the central plane A of each bellows-shaped deformable portion 38 is essentially perpendicular to the supporting surface of the backrest panel 26. This arrangement means that when the backrest panel 26 is tilted backwards under the thrust applied by the user, the upper part of each bellows-shaped deformable portion 38 extends, while the lower part of each bellows-shaped deformable portion 38 compresses. When the loops of the lower parts of the bellows-shaped deformable portions 38 come into contact with each other, there is a stop effect, which limits the maximum rearward inclination of the backrest 24.

Figure 5:
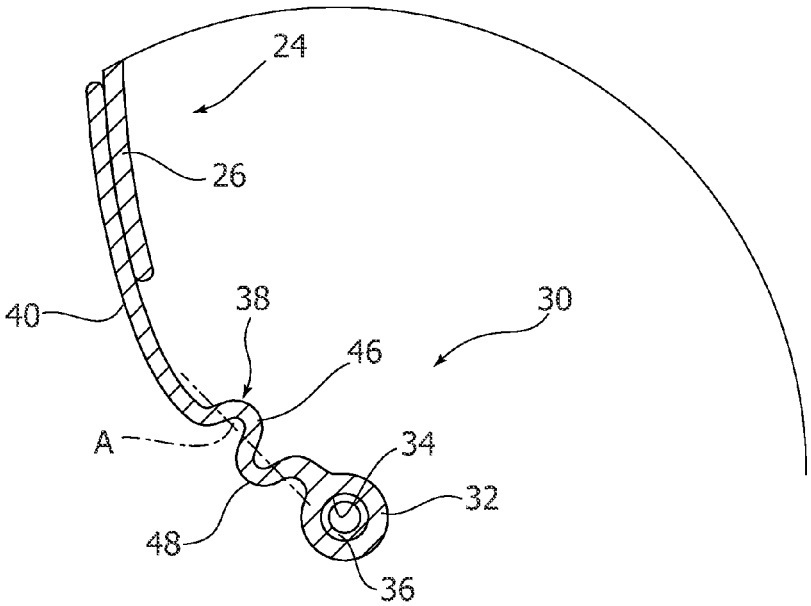
FIG. 5 is a detail analogous to FIG. 4, illustrating an alternative embodiment.

In the variant of FIG. 5 and in the embodiment illustrated in FIGS. 6 to 8, the bellows-shaped deformable portions 30 are oriented in a different manner. In this case, the central plane A of each bellows-shaped deformable portion is essentially tangential to the supporting surface of the backrest panel 26. In this case, the loops of the bellows do not come into abutment with each other during the backward tilt of the backrest 24. However, the bellows geometry is also exploited in this version to control the elasticity of the backrest bending.

Of course, many different configurations of the bellows-shaped deformable portions are possible. For example, FIG. 6 illustrates an example in which each bellows-shaped deformable portion 38 has a central opening 50 which divides the bellows-shaped deformable portion into an upper portion and a lower portion. As is illustrated in FIGS. 7 and 8, the upper portion and the lower portion of the bellows-shaped deformable portion 38 can have a different pitch and different amplitude of the undulations.

Of course, without prejudice to the principle of the invention, the details of construction and the embodiments may vary widely with respect to those described and illustrated without departing from the scope of the invention as defined by the following claims.

The invention claimed is:

1. A chair comprising:

a fixed support structure including a pair of front legs and a pair of rear legs;

a seat fixed to the fixed support structure;

a backrest including a backrest panel with an arcuate supporting surface connected in a tilting manner to the fixed support structure; and two side connecting elements of plastic material, each of which comprises a cylindrical sleeve fixed to an upper portion of a respective rear leg and a bellows-shaped deformable portion having a first end integrally formed with the respective cylindrical sleeve and a second end connected in a fixed manner to a respective side portion of the backrest panel, each of the bellows-shaped deformable portions comprising a series of C-shaped arcuate portions extending between the first end and second end on opposite sides of a respective central plane essentially perpendicular to the supporting surface of the backrest panel.

2. A chair according to claim 1, wherein the second end of each of the bellows-shaped deformable portions is integrally formed as a side extension of a frame to which the backrest panel is fixed.

3. A chair according to claim 1, wherein the second end of each of the bellows-shaped deformable portions is integrally formed as a side extension of the backrest panel.

4. A chair according to claim 1, wherein said cylindrical sleeves are fitted on an upward extension of the respective rear legs.

5. A chair according to claim 1, further comprising two armrests having respective fastening portions extending upward from respective upper ends of said cylindrical sleeves.

6. A chair according to claim 1, wherein the C-shaped arcuate portions provide a stop which limits the maximum rearward inclination of the backrest when lower parts of the bellows-shaped deformable portions come into contact with each other.

7. A chair comprising:

a fixed support structure including a pair of front legs and a pair of rear legs;

a seat fixed to the fixed support structure;

a backrest including a backrest panel with an arcuate shape supporting surface connected in a tilting manner to the fixed support structure; and two side connecting elements of plastic material, each of which comprises a cylindrical sleeve fixed to an upper portion of a respective rear leg and a bellows-shaped deformable portion having a first end integrally formed with the respective cylindrical sleeve and a second end connected in a fixed manner to a respective side portion of the backrest panel, each of the bellows-shaped deformable portions comprising a series of C-shaped arcuate portions extending between the first end and second end on opposite sides of a respective central plane essentially perpendicular to the supporting surface of the backrest panel.

8. A chair according to claim 7, wherein the second end of each of the bellows-shaped deformable portions is integrally formed as a side extension of a frame to which the backrest panel is fixed.

9. A chair according to claim 7, wherein the second end of each of the bellows-shaped deformable portions is integrally formed as a side extension of the backrest panel.

10. A chair according to claim 7, wherein the cylindrical sleeves are fitted on an upward extension of the respective rear leg.

11. A chair according to claim 7, further comprising two armrests having respective fastening portions extending upward from respective upper ends of the cylindrical sleeves.

* * * * *